United States Patent [19]

Ingalls

[11] Patent Number: 4,527,967

[45] Date of Patent: Jul. 9, 1985

[54] SCREW ROTOR MACHINE WITH SPECIFIC TOOTH PROFILE

[75] Inventor: Robert A. Ingalls, Springfield, Vt.

[73] Assignee: Dunham-Bush, Inc., West Hartford, Conn.

[21] Appl. No.: 645,958

[22] Filed: Aug. 31, 1984

[51] Int. Cl.[3] ..... F01C 1/16; F01C 1/24

[52] U.S. Cl. ..... 418/150; 418/201

[58] Field of Search ..... 418/150, 201

[56] References Cited

U.S. PATENT DOCUMENTS

| | | | |
|---|---|---|---|
| 4,053,263 | 10/1977 | Ingalls | 418/201 |
| 4,088,427 | 5/1978 | Emanuelsson | 418/201 |
| 4,140,445 | 2/1979 | Schibbye | 418/201 |
| 4,210,410 | 7/1980 | Ohtani | 418/150 |

*Primary Examiner*—Leonard E. Smith
*Assistant Examiner*—Jane E. Obee
*Attorney, Agent, or Firm*—Sughrue, Mion, Zinn, Macpeak, and Seas

[57] ABSTRACT

Helical screw rotors for a screw rotor machine having improved asymmetric screw profiles on both male and female rotors, wherein the male rotor lobe leading flank comprises solely first and second circular arcs with the first circular arc subscribed by a first radius which lies on a radial line through the male rotor center at an offset angle to the male rotor lobe center line in the direction of the trailing flank of the rotor lobe to create a male rotor tip point inherently including a male rotor lobe sealing strip. Groove trailing flank portions of the female rotor lobes are defined by first and second circular arcs subscribed by first and second radii within addendum and dedendum portions of the female rotor lobes, providing a smooth uninterrupted surface starting below the pitch circle and terminating at or near the outside diameter of the female rotor lobes, with the point of tangency of the first and second radii of the female groove trailing flank portion occurring at a point of zero sliding with the male rotor on the pitch circle. The female rotor lobes have a main lobe peripheral surface defined by a true circular arc swung from an offset circle centered on the rotor axis at the groove trailing side, inherently producing a female rotor lobe sealing strip and significantly reducing the blow hole area of the screw rotor machine.

9 Claims, 4 Drawing Figures

SCREW ROTOR MACHINE WITH SPECIFIC TOOTH PROFILE

FIELD OF THE INVENTION

This invention relates to screw rotor machines for compression and expansion of a working fluid, and more particularly, to improved screw rotor profiles producing inherent sealing strips for both the male and female rotors, smaller blowholes, and reduced wear while eliminating the need for surface hardening of contacting rotor surfaces.

BACKGROUND OF THE INVENTION

Screw rotor machines employable, both for compression or expansion of an elastic working fluid, have used asymmetric rotor profiles for improved efficiency of the compression or expansion process. The development of asymmetric screw rotor profiles is exemplified by U.S. Pat. Nos. 3,423,017, 4,140,445, and 4,435,139, assigned to Svenska Rotor Maskiner; U.S. Pat. Nos. 4,053,263 and 4,109,362 issued to the present applicant, and assigned to the Joy Manufacturing Company; and U.S. Pat. Nos. 4,401,420 and 4,406,602 assigned to the Hitachi Corporation.

Screw rotor machines, whether functioning as compressors or expanders, are formed normally of a cast or machined casing or housing bearing two parallel, laterally intersecting cylindrical bores opening at respective ends to high pressure and low pressure ports. Within the bores, there are mounted for rotation, interengaging helical screw rotors of the male and female type provided with helical lobes or lands and intervening grooves having wrap angles normally less than 300 degrees. Typically, the male rotor is a rotor in which each lobe and groove has at least its major portion located outside the pitch circule of the rotor and has two generally convex flanks located outside the pitch circle, while the female rotor comprises a rotor in which each lobe and groove has at least its major portion located inside the pitch circle of the rotor and has two generally concave flanks located inside the pitch circle of the rotor.

Particularly in the smaller size compressors and expanders, it is preferred that the female rotor physically drive the male rotor. Typically, the female, driving rotor may consist of six lobes, while the male, driven rotor may constitute four lobes and thus be rotated at one-half greater speed. In such female drive arrangement, the majority of lobe action occurs in the arc of approach or behind the line of centers. This is a particularly destructive type of lobe action, because the direction of sliding of one lobe surface on the other is towards the pitch diameters and results in a spreading force which opposes rotation. With respect to SRM U.S. Pat. Nos. 3,423,017 and 4,140,445, Joy U.S. Pat. Nos. 4,053,263 and 4,109,326 and Hitachi U.S. Pat. Nos. 4,401,420 and 4,406,602, this condition exists.

Regarding the more recently issued U.S. Pat. No. 4,435,139 of SRM, while the rotor profiles are exemplified as favoring a female drive situation and a minimization in the destructive type of lobe action, that patent, in achieving a smooth profile surface, utilizes a relatively small radius forming a portion of the lobe surface considerably below the pitch circle which results in a blow hole which is considerably larger than that which is present in its earlier screw rotor profiles, as exemplified by U.S. Pat. Nos. 3,423,017 and 4,140,445.

In both Hitachi U.S. Pat. Nos. 4,401,420 and 4,406,602, relatively small blow holes are achieved by the use of very small tip radii and very small or in some cases negative female addendums. This results in a virtually impossible situation if the female rotor is functioning to drive the male rotor. In SRM U.S. Pat. Nos. 3,423,017 and 4,140,445, as well as my earlier U.S. Pat. Nos. 4,053,263 and 4,109,362, a sharp line occurs on the female rotor where the point generated dedendum portion intersects the profile near the pitch circle. This also equates to the small radii characterized by the profiles of the Hitachi U.S. Pat. Nos. 4,401,420 and 4,406,602, and the result is a highly destructive wear problem for the interconnected rotors.

In an attempt to minimize wear as a result of such interference, localized hardening is necessary at the pitch surfaces of most female drive rotors to insure sufficient life to the helical screw rotors to justify their cost.

It is, therefore, a primary object of the present invention to provide an improved helical screw rotary machine having rotor profiles which improve meshing conditions, minimize leakage paths in the compressor or expander, improve cutting conditions in the manufacture of the rotors, and wherein the requirement for laser or other localized hardening of the lobes in the vicinity of the pitch surfaces is substantially eliminated.

SUMMARY OF THE INVENTION

The invention is directed to the particular profiles of both male and female helical screw rotors for screw rotor machines, such as a compressor or an expander. The elongated formed female rotor is adapted for rotation about its central longitudinal axis and has a pitch circle centered on the axis and an outer diameter. A plurality of elongated helical lobes extend longitudinally of the rotor and circumferentially spaced about the pitch circle so as to provide intervening grooves therebetween forming addendum portions outside the pitch circle and dedendum portions inside the pitch circle. A major portion of each of the lobes extends generally radially inwardly of the pitch circle and the profile of each of the lobes in a plane perpendicular to the axis has a tip portion and respective generally concave groove leading and trailing flank portions extending intermediate said tip portion and a root portion of the respective adjacent groove. The lobes of the female rotor engage grooves of the male rotor defined by corresponding helical lobes of the male rotor with contact between the flank portions of respective female and male rotors during rotation of one rotor relative to the other. The improvement resides in the profile of the trailing flank portion of the female rotor groove being defined by first and second circular arcs formed by first and second radii within the addendum and dedendum portions of the lobe, respectively, providing a smooth uninterrupted surface starting below the pitch circle and terminating at or near the outside diameter of the rotor with the point of tangency of the first and second radii occurring at a point of zero sliding with the male rotor on the pitch circle. The effect of this is that the female rotor groove trailing flank portion facilitates female rotor drive of the male rotor, reduction in blow holes formed between the female and male screw rotors, minimizes spreading forces acting on the rotors opposing their rotation, and loading of bearings mounting the rotors for rotation about their axis. Further, the respective centers for the two radii may lie inside the pitch circle for the female rotor.

For such female rotor, the main peripheral surface of each female rotor lobe may be defined by a true circular arc swung from an offset circle centered on the female rotor axis, at the trailing side of the female lobe tip, forming a female rotor lobe sealing strip to materially reduce the blow hole area of the screw rotor machine.

Additionally, a lobe surface portion may be defined by a third circular arc extending from the addendum circular arc portion of the trailing flank to the female rotor lobe outer periphery subscribed by a third radius whose length is between zero and a length such that the center of the third radius lies on the pitch circle and wherein the third radius is within the addendum of the female rotor lobe on the trailing flank side and is tangent with the periphery of the rotor lobe and with the first circular arc forming the trailing flank portion within the addendum and whose point of tangency with that first circular arc is radially outside of the pitch circle.

The invention has further application to a male rotor for such screw rotor machines in which the elongated formed male rotor is rotatable about a central longitudinal axis and has a pitch circle centered on the axis. A plurality of elongated helical lobes extend longitudinally of the male rotor and circumferentially spaced about the pitch circle so as to provide intervening grooves therebetween, and a major portion of each of the lobes extends generally radially outwardly from the pitch circle. The profile of each of the lobes in a plane perpendicular to the axis has a tip portion and respective generally convex leading and trailing flank portions extending intermediate the tip portion and the root portion of the respective adjacent grooves. The improvement resides in the male rotor lobe leading flank portion profile comprising solely first and second circular arcs including a first circular arc defined by a first radius which lies on a radial line through the rotor center at an offset angle to the male rotor lobe centerline in the direction of the trailing flank of the rotor lobe, creating a male rotor high crest or tip point adjacent to the lobe trailing side, minimizing leakage of gas and eliminating the necessity of a separate milling operation. The first circular arc has a radial drop in the direction of the lobe leading side and the high crest point forming a male rotor lobe sealing line with other points along the helix to minimize leakage of the working fluid to thereby eliminate the necessity of a separate seal machining operation and thus reducing the cost of producing the male rotor.

In such male rotor, the center of the first radius subscribing the first circular arc forming the male rotor lobe tip lies on a radial line through the rotor center at an offset angle and is inside the pitch circle, and the second circular arc is subscribed by a second radius whose center is inside the pitch circle and within the dedendum of the male rotor lobe. The point of tangency or blend of the second radius with the first radius occurs outside of the pitch circle, and the second circular arc defined by the second radius terminates inside the pitch circle within the dedendum of the male rotor lobe, resulting in highly effective sealing surfaces for said male rotor lobe with said female rotor groove and female rotor groove having an increased swept volume, resulting in more efficient compressor or expander operation while permitting the effective active pressure angle to be fine tuned.

Further, in the area of the male rotor lobe tip at the junction of the trailing and lading flanks, a lobe surface may be defined by a third circular arc subscribed by a third radius whose length is within the range of zero to five percent of the male rotor outside diameter, and wherein the center of that third radius is within the lobe addendum and positioned such that the third radius is tangent to the trailing and leading flank surface portions at the intersection therewith of the circular arc subscribed by the third radius to facilitate rotor machine operation operating and/or cutting conditions and to provide flexibility to the rotor profile without adversely affecting compressor or expander efficiency.

The invention is further directed to a pair of such male and female helical rotors for a screw rotor machine in the form described previously.

DESCRIPTION OF THE PREFERRED EMBODIMENT

Figure 1:
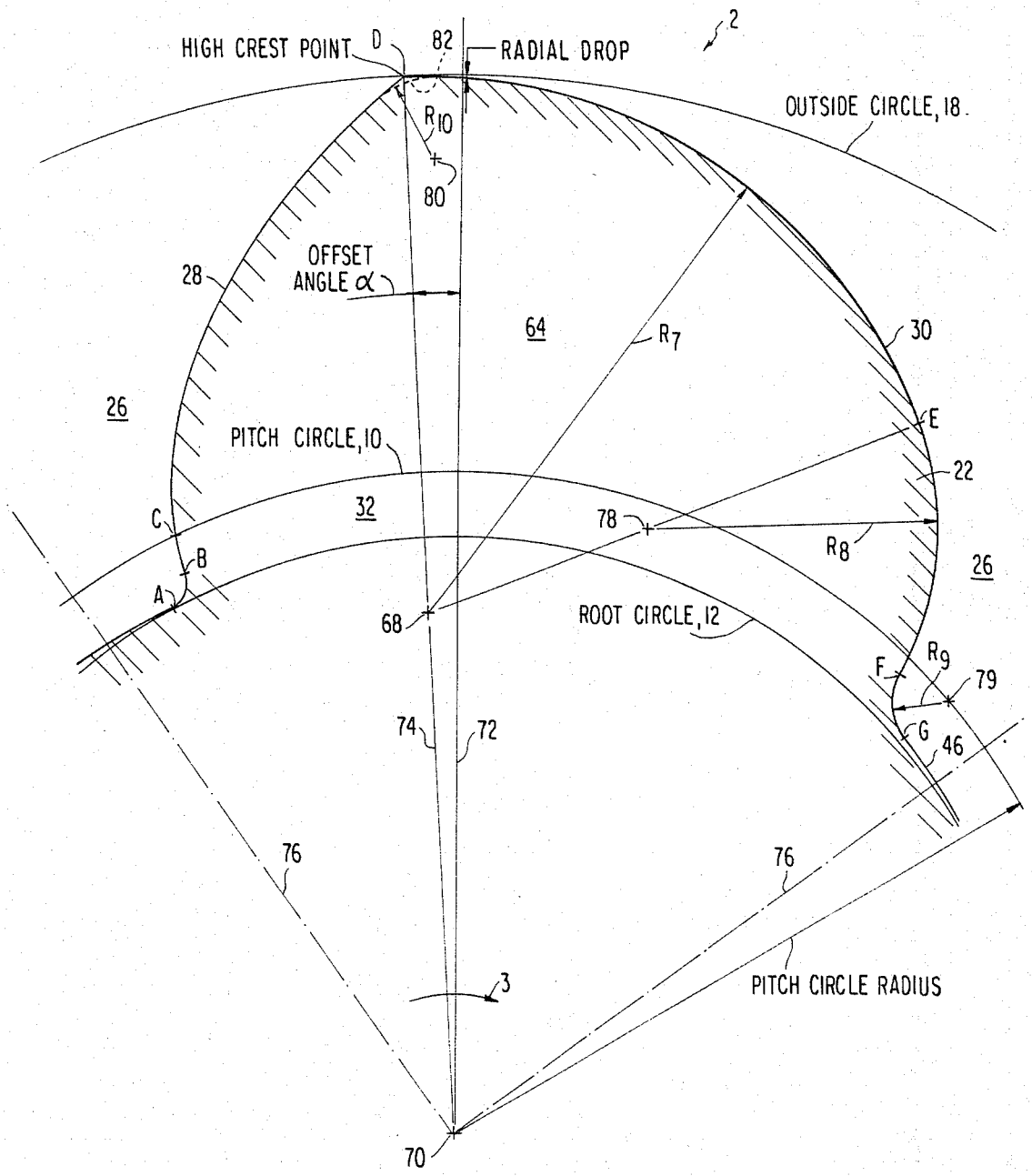
FIG. 1 is a fragmentary cross-sectional view in the plane of rotation of the male rotor constructed in accordance with the present invention.
Figure 2:
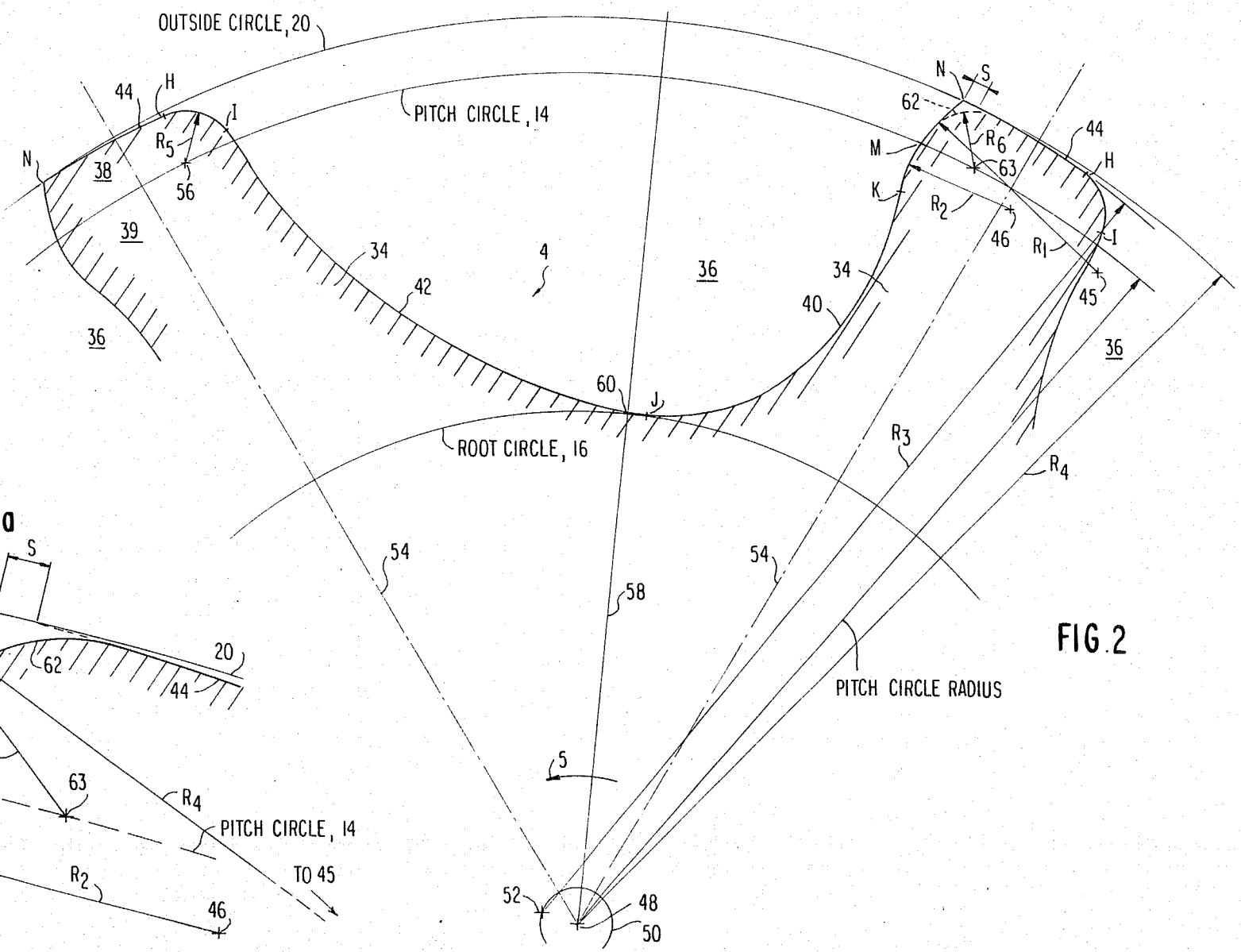
FIG. 2 is a fragmentary cross-sectional view taken in the plane of rotation of a female rotor constructed in accordance with the present invention.

In FIGS. 1 and 2, there are shown, in transverse section relative to the axis of the rotors, the profiles of a male helical screw rotor, indicated generally at 2, and a helical screw female rotor, indicated generally at 4, respectively. Further, the profiles illustrate in FIG. 1 a single complete male rotor lobe and, in FIG. 2, female rotor lobes defining a groove therebetween. As may be appreciated, in customary practice, the profiles are described by outlining the method by which the profiles are developed over their complete exterior surface.

In the development of the rotor profiles, the operating parameters of the compressor are initially determined. In the illustrated embodiment, the female rotor 4 drives male rotor 2, as per arrows 3 and 5, respectively, FIGS. 1 and 2. The outside diameter of the rotors and the center distance between the rotors which are intermeshed and which rotate within respective rotor bores (not shown) are defined. The pitch diameters of the male and female rotors 2, 4 are calculated and the related root diameters are derived from the relationship to the outside diameters of the mating rotors.

The pitch circle for the male rotor 2 is indicated at 10 and the root circle at 12. For the female rotor 4, the pitch circle is indicated at 14 and the root circle at 16. As may be appreciated, the lobe thickness of the female rotor on the pitch circle is set at a predetermined value to provide suitable thermal conductivity and the necessary mechanical strength to avoid deformation or destruction under the forces of compression. The outside diameter circle is indicated at 18 for male rotor 2, and at 20, for female rotor 4. The radially projecting lobes or lands 22 of the male rotor 2 form grooves 26 therebetween. In that respect, each male rotor lobe 22 comprises a lobe trailing flank 28 when the machine is functioning as a compressor, but which becomes the leading flank thereof when operating as an expander. To the oppsite side of the male lobe 22, each male rotor lobe is completed by a lobe leading flank 30, when the machine is functioning as a compressor or a trailing flank when the machine is functioning as an expander, respectively.

With the male rotor 2 having four helical lobes 22 and intervening grooves 26, the lobes 22 have a wrap angle of about 300 degrees.

In corresponding fashion, the female rotor 4 has its six helical lobes or lands 34 separated by the intervening grooves 36. The female rotor lobes 34 are provided with addendums 38 located radially outside of the pitch circle 14, while the male rotor has dedendums 32 located inside pitch circle 10 of that rotor. The female lobes are completed by dedendums 39, inside the pitch circle 14. Each female rotor groove 36 is formed by a groove trailing flank 40 of lobe 34 when the machine is functioning as a compressor and which becomes the leading flank when operating an expander. To the opposite side of groove trailing flank 40 is groove leading flank 42 when the machine functions as a compressor which becomes a trailing flank when the machine functions as an expander. Each of the flanks 40, 42 extend from a radially innermost root portion bottom point "J" of groove 36 out to the crest portions 44 of respective adjacent lobes 34.

Similarly, for male rotor 2, each of the lobe flanks 28, 30 extend from a radially innermost bottom or root portion "A" of the male rotor groove 26 out to the crest point D of lobes 22.

The present invention includes as a very important aspect of the rotor profile for the female rotor 4, the utilization of two radii partially defining the female groove trailing flank 40 to form a smooth uninterrupted surface of the trailing flank, running from a point N at the outside diameter 20 through the pitch circle 14 to point K. The first, M-N, of the two surface portions defined by these two radii, extends in the form of a circular arc subscribed by a radius $R_1$ whose center of radius 45 lies inside the pitch circle 14. The second, groove trailing flank surface portion, K-M, is created by subscribing an arc, via radius $R_2$ whose center 46 also lies inside the pitch circle 14. The effect of this is to provide a smooth uninterrupted convex surface portion by blending the circular arcs produced by the radii $R_1$ $R_2$, with the point of tangency of both radii $R_1$, $R_2$ occuring at point M of "zero" sliding on the pitch circle 14. Further, the female groove trailing flank portion M-K smoothly blends with the male rotor generated surface portion J-K of trailing flank 40, at point K.

The present invention is further characterized by the unique profile feature of the female lobe geometry N-H. Unlike the prior art female rotor profiles, discussed above, the main lobe is not defined by a true radius swung from female rotor center 48. In the present invention, the main lobe surface portion N-H is a true radius swung from an offset circle 50, which offset circle is centered on the rotor center 48. The center 52 of radius $R_3$ is on the offset circle 50 to the groove trailing side of female lobe centerline 54. Specifically, the center of radius $R_3$, subscribing the female lobe peripheral surface portion N-H, intersects the outside diameter 20 which is defined by a true radius $R_4$ from center 48 of the female rotor 4. This creates a sealing strip S, starting at point N, thereby completely eliminating the necessity for a specially formed radially projecting sealing strip such as those at 32 of my earlier U.S. Pat. No. 4,053,263. As a result, there is a substantial reduction in production costs over previous rotors.

Additionally, as will be seen hereinafter, the unique lobe or land crest portion 44 generates the root of the mating male rotor 2 with the result that a root groove is no longer necessary for the male rotor, such as groove 41 within my earlier U.S. Pat. No. 4,053,263. This eliminates a leakage path and does away with the need for small, vulnerable protuberances on the hobs, milling cutters or other cutting tools normally employed in manufacturing male rotor. This element of the cutting tool has long been a problem as it becomes dull first and results in a tool which requires repeated sharpening. Additionally, as may be perceived by viewing FIG. 2, with the center line 54 for the lobe or land 44 to the right of the sealing strip S adjacent to point N on the groove trailing flank side of the female rotor, the effect is a further reduction in the blow hole area between rotors, thereby increasing the efficiency of the compression process. The main lobe periphery formed by surface portion N-H, being defined by a circular arc swung from the offset circle 50 centered on the rotor center 48, at point 52, extends to both sides of the lobe center line 54. As such, it is formed of two segments: a first segment or section from tip point N to lobe center line 54, and a second segment from the lobe center line 54 to point H. Also, sealing strip S is concentric to female rotor center 48.

The part of the addendum 38, surface H-I, of the leading flank 42 is defined by a circular arc subscribed by radius $R_5$, whose center of radius 56 lies on pitch circle 14.

The short female rotor groove leading flank addendum surface portion H-I, subscribed by radius $R_5$, is tangent to the offset lobe radius $R_3$ at point H, and the male rotor generated surface portion I-J of the trailing flank 42 at point I.

As a further aspect of the present invention, the female rotor groove leading flank surface portion I-J, primarily within dedendum 39, is generated by the male rotor lobe tip radius subscribed leading flank surface portion D-E and further radius subscribed leading flank surface portion E-F. This generated surface portion, I-J, passes through groove 36 center line 58, at point 60. The female rotor groove trailing flank 40 surface portion J-K of the female rotor 4 is also generated by the male rotor 2, specifically by male rotor lobe point D (or a D radius as a modification thereof).

Figure 2A:
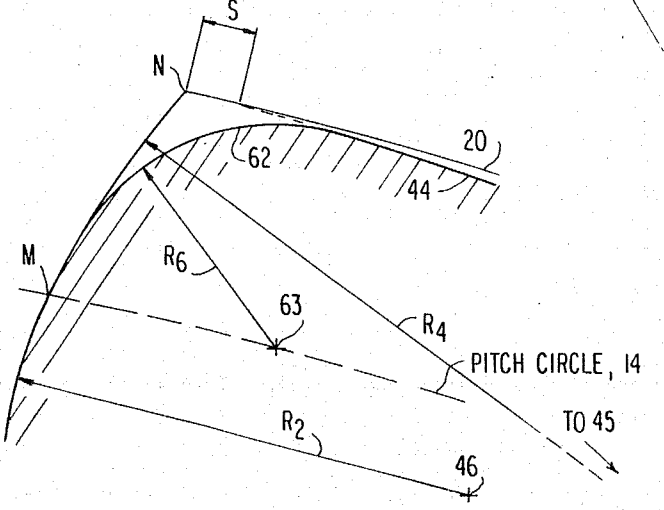
FIG. 2*a* is an enlarged sectional view of a modified tip portion of the female rotor of FIG. 2.

The female rotor lobe tip, while illustrated in solid line in FIG. 2 as a sharp point N, may be modified such that a small circular arc defines a corresponding surface area of female rotor lobe 34, depending on operating and/or cutting conditions for the rotor. Specifically, by reference to FIG. 2*a*, there is shown an alternative lobe flank surface portion 62 formed by subscribing an arc via radius $R_6$ from a point 63 which is on the pitch circle 14. Thus, the minimum radius would be zero resulting in the formation of the sharp point N, while the maximum radius is one in which the center of radius $R_6$ is located on the pitch circle 14.

In that respect, it is within the addendum of the female rotor lobe on the groove trailing flank side and is tangent with the periphery or crest portion 44 of the female rotor lobe at one end and with the first circular arc defining surface portion, M-N, with the point of tangency of the third circular arc with that of the first circular arc being radially outside of the pitch circle 14.

It should be appreciated, that in subscribing the circular arc defining the female rotor groove trailing flank surface portion K-M of the female rotor, which is within the female rotor lobe dedendum 39, the radius center 46 for radius $R_2$ is below the pitch circle 14 and that circular arc is tangent to the addendum portion M-N of trailing flank 40 at the pitch circle, point M. Likewise, for the addendum portion M-N of the trailing flank 40, the radius $R_1$ is approximately twice the length of the dedendum radius $R_2$ and similarly is tangent with groove trailing flank surface portion K-M at the pitch circle 14.

Turning to the male rotor 2, FIG. 1, the male rotor lobes or lands 22 consist of male rotor lobe leading flank 30 and male rotor lobe trailing flank 28. Leading flank 30 begins at point D constituting the radial tip of each of the lands or lobes 22 on the outside diameter 18. At the leading flank 30, the male tip and a significant portion of the leading flank 30 is defined by a circular arc D-E whose center is to the left of male rotor lobe center line 72 and on a radial line 74 emanating from the rotor center 70 and intersecting the outside diameter 18 to define point D and forming a radial drop along the male rotor lobe leading flank 30. The lobe center line 72 is located between the center lines 76 for grooves 26 to each side of lobe 22. Thus, the location of the center 68 of the male tip radius $R_7$ is on radial line 74 through the rotor center 70, at an offset angle $\alpha$, towards the trailing flank 28. This results in the creation of high crest point D initiating the trailing flank 28 profile and forms a sealing point which combines with other sealing points along the helix to form a seal line and thus, does not require a separate milling operation, as is necessary with Holroyd milled male rotors.

The male rotor lobe tip radius $R_7$ is tangent to a second radius $R_8$. The center 78 of radius $R_8$ lies below the pitch circle 10 with the point of tangency or blend point E of the two radii $R_7$, $R_8$, occurring above the pitch circle 10. The center 78 of the second radius $R_8$ may be varied in size and/or position to result in higher or lower active pressure angles as required to fit cutting methods and conditions for the male rotor. As may be appreciated, radius $R_8$ is tangent to the tip radius $R_7$ at point E in the addendum 64 of the male rotor lobe or land 22, while radius $R_8$ is also tangent to male rotor lobe root surface portion F-G at point F, within the dedendum 32 of the male rotor lobe 22. Radius $R_7$ and $R_8$ combine with generally concave surface portions I-J of the female rotor groove leading flank, FIG. 2, to provide highly efficient sealing surfaces therebetween, resulting in more efficient compressor or expander operation, while allowing the effective active pressure angle to be fine-tuned.

The root surface portion F-G of the male rotor land or lobe 22 on the leading flank 30 side is subscribed by a radius $R_9$, whose center 79 lies on the pitch circle 10.

Male rotor lobe root surface portion G-A is generated by female rotor lobe surface portion N-H of the female rotor 4. The trailing flank surface portion A-B of the male rotor 2 is a trochoidal concave surface portion which is generated by either point N of the female rotor lobe 34 or an equivalent N radius female rotor groove trailing flank surface portion of the female rotor (arc 62).

The trailing flank surface portion B-C of the male rotor lobe 22 is generated by female rotor lobe addendum radius subscribed surface portion M-N on the female rotor lobe 34.

The trailing flank major surface portion C-D is generated by the female lobe dedendum, radius subscribed, surface portion K-M of the groove trailing flank 40 of female rotor 4.

This completes the description of profile for the lands or lobes 22 of the male rotor 2.

From the above, it may be appreciated that the two radii $R_1$, $R_2$ on the female rotor groove trailing flank side of the female rotor lobe 34 combined with the male rotor lobe trailing flank portions B-C and C-D, generated by these radii $R_1$, $R_2$ results in improved and optimized female drive conditions for the intermeshed helical screw rotors 2, 4. The sharp intersection between intersecting profile surfaces adjacent to the pitch circle on existing rotor profiles, as exemplified by the patents discussed previously, is eliminated. The present invention replaces those surfaces with smoothly blended non-destructive curved arc, radius subscribed convex surfaces. This results in the area of contact between the male 32 and female 34 rotor lobes to be increased in both the addendum and dedendum portions resulting in reductions in contact stresses when operating under female drive mode.

Corresponding to female rotor 4, male rotor 2, instead of having a sharp male tip point D, may have its rotor profile in this area modified to provide a small diameter circular arc over a portion of the surface where the trailing flank 28 merges with the leading flank 30. A radius equal to zero produces the sharp point D. However, that radius $R_{10}$ may be increased to a maximum of 5% of male rotor diameter. The maximum radius for $R_{10}$ emanate from a center point 80, the effect of which is to round off the surface of the male rotor lobe or land 22 in the vicinity of its outside diameter, and produce a circular arc indicated in dotted lines as at 82, FIG. 1. The length of radius $R_{10}$ depends on operating and/or cutting conditions to be met, thus providing flexibility to the design without measurably affecting compressor or expander efficiency.

As may be appreciated, where the tip on the male rotor in the vicinity of point D is smoothed by the creation of a surface portion defined by circular arc 82 as a result of being so subscribed by radius $R_{10}$, that surface portion so subscribed is tangent to trailing and leading flank surface portions at the intersection therewith to facilitate rotor machine operating and/or cutting conditions, to provide flexibility to the rotor profile and under conditions which do not adversely affect compressor or expander efficiency.

Figure 3:
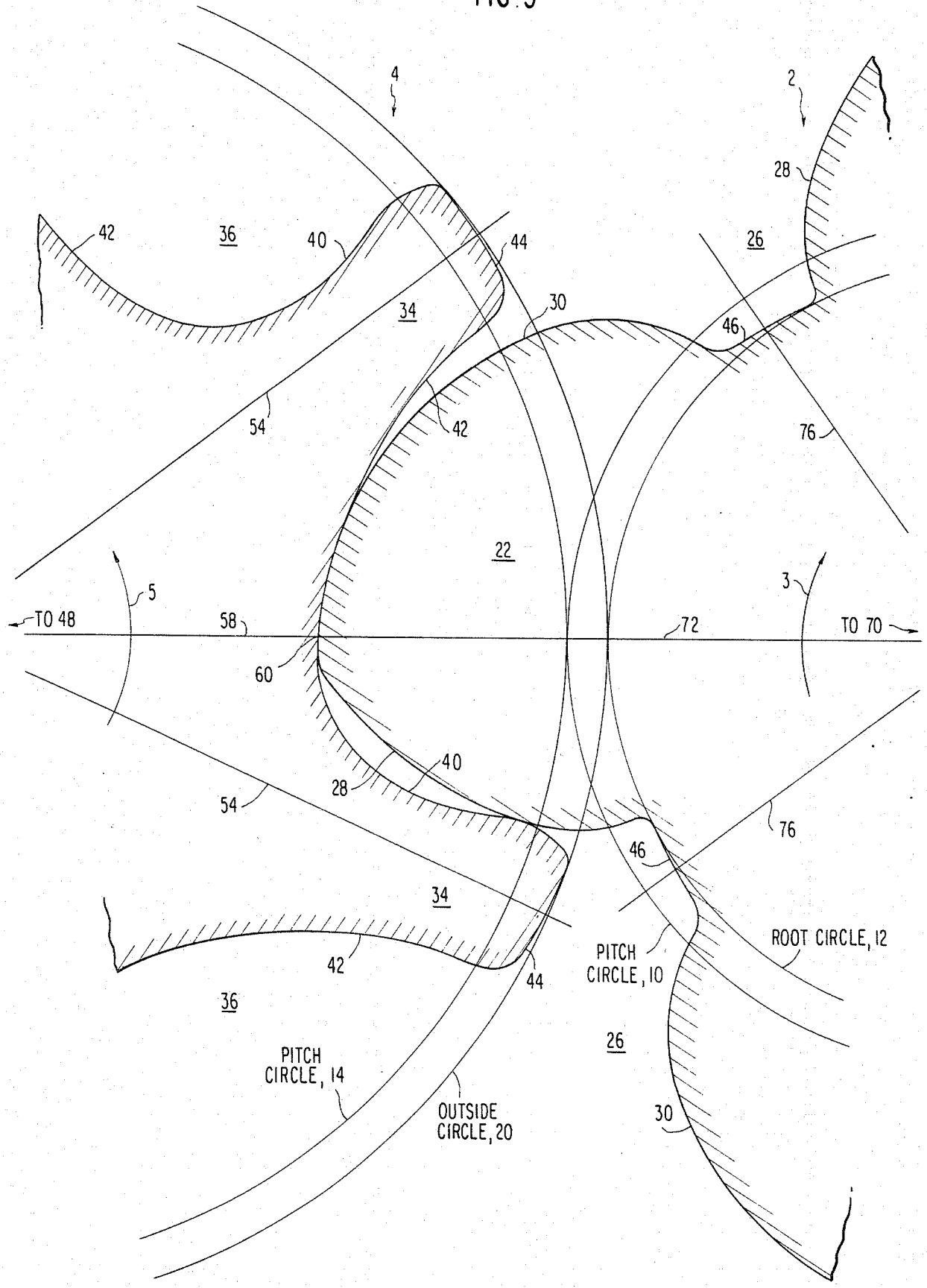
FIG. 3 is a cross-section in the plane of rotation of a pair of intermeshed rotors in accordance with FIGS. 1 and 2.

As may be appreciated, rotating the male rotor 2, surface portions D-E, and the second radius subscribed portion F-E on the male rotor lobe 22, generate the leading profile portion I-J of the female rotor groove 36. The effect of such rotation of the male and female rotors may be seen in FIG. 3.

The profiles shown and described are reproducible over the wide range of rotor sizes employed in actual practice. The invention has application to intermeshed helical screw rotors, male or female driven, having a greater number or lesser number of lobes. Both rotors may have their pitch diameters, and center distances vary as needed.

While the invention has been particularly shown and described with reference to a preferred embodiment thereof, it will be understood by those skilled in the art that various other changes in form and details may be made therein without departing from the spirit and scope of the invention.

What is claimed is:

1. A female rotor for a screw rotor machine comprising:

an elongated formed female rotor rotatable about a central longitudinal axis and having a pitch circle centered on said axis, said rotor having an outer diameter;

a plurality of elongated helical lobes extending longitudinally of said rotor and circumferentially spaced about said pitch circle so as to provide intervening grooves therebetween forming addendum portions outside the pitch circle and dedendum portions inside the pitch circle;

a major portion of each of said lobes extending generally radially inwardly of said pitch circle;

the profile of each of said lobes in a plane perpendicular to said axis having a tip portion and respective generally concave groove leading and trailing flank portions extending intermediate said tip portion and a root portion of the respective adjacent groove;

and wherein said lobes of said female rotor engage grooves of a male rotor defined by corresponding helical lobes of the male rotor with contact between flank portions of respective female and male rotors during rotation of one rotor relative to the other;

the improvement wherein the profile of the groove trailing flank portion of said female rotor is defined by first and second circular arc portions subscribed by first and second radii within the addendum and dedendum portions of said lobe, respectively, providing a smooth uninterrupted surface, starting below the pitch circle and terminating at or near the outside diameter of the rotor with the point of tangency of the first and second radii occurring at a point of zero sliding with the male rotor on said pitch circle;

whereby, said female rotor groove trailing flank surface portion facilitates female rotor drive of the male rotor, reduction in blow holes formed between the female and male screw rotors, and reduction of spreading forces acting on the rotors opposing their rotation and loading of bearings mounting said rotors for rotation about their axes.

2. A female rotor for a screw rotor machine comprising:

an elongated female formed rotor rotatable about a central longitudinal axis and having a pitch circle centered on said axis, said rotor having an outer diameter;

a plurality of elongated helical lobes extending longitudinally of said rotor and circumferentially spaced about said pitch circle so as to provide intervening grooves therebetween;

a major portion of each of said lobes extending generally radially inwardly of said pitch circle;

the profile of each of said lobes in a plane perpendicular to said axis having a tip portion and respective generally concave groove leading and trailing flank portions extending intermediate said tip portion and a root portion of the respective adjacent groove;

and wherein said lobes of said female rotor engage grooves of a male rotor defined by helical lobes of respective female and male rotors during rotation of one rotor relative to the other;

the improvement wherein the main peripheral surface of each female rotor lobe is defined by a true circular arc swung from an offset circle centered on the female rotor axis at the groove trailing side of the female lobe tip, forming a female rotor lobe sealing strip to materially reduce the blow hole area of the screw rotor machine.

3. The female rotor as claimed in claim 1, wherein the main lobe peripheral surface is defined by a true circular arc swung from an offset circle centered on the rotor axis at the groove trailing side of the female lobe tip producing a female rotor lobe sealing strip and significantly reducing the blow hole area of the screw rotor machine.

4. The female rotor as claimed in claim 1, wherein respective centers for said two radii are inside the pitch circle.

5. The female rotor as claimed in claim 4, further comprising a lobe surface portion defined by a third circular arc extending from said addendum circular arc portion of said trailing flank to said female rotor lobe outer periphery subscribed by a third radius whose length is between zero and a length such that the center lies on the pitch circle, and wherein said third circular arc is within the addendum of the female rotor lobe on the trailing flank side and is tangent to the periphery of the rotor lobe and with the first circular arc forming the trailing flank portion within said addendum, and whose point of tangency with that first circular arc is radially outside of said pitch circle.

6. A male rotor for a screw rotor machine comprising:

an elongated formed male rotor rotatable about a central longitudinal axis and having a pitch circle centered on said axis;

a plurality of elongated helical lobes extending longitudinally of said male rotor and circumferentially spaced about said pitch circle so as to provide intervening grooves therebetween;

a major portion of each of said lobes extending generally radially outwardly from said pitch circle;

the profile of each of said lobes in a plane perpendicular to said axis having a tip portion and respective, generally convex lobe leading and trailing flank portions extending intermediate said tip portion and the root portion of the respective adjacent groove;

the improvement wherein said male rotor lobe leading flank portion is defined solely by first and second circular arcs including a first circular arc subscribed by a first radius which lies on a radial line through the rotor center at an offset angle to the male rotor lobe center line in the direction of the trailing flank of said rotor lobe, creating a male rotor high crest point adjacent to the lobe trailing side, minimizing leakage of gas and eliminating the necessity of a separate milling operation, said first circular arc having a radial drop in the direction of the lobe leading side such that said high crest point forms a male rotor lobe sealing line with other sealing points along the helix to minimize leakage of working fluid, thereby eliminating the necessity of a separate seal machining operation and thus reducing the cost of producing the male rotor.

7. A male rotor for a screw rotor machine comprising:

an elongated formed male rotor rotatable about a central longitudinal axis and having a pitch circle centered on said axis;

an outside diameter radially beyond said pitch circle;

a plurality of elongated helical lobes extending longitudinally of said rotor and circumferentially spaced about such pitch circle so as to provide intervening grooves therebetween outside the pitch circle and lobe dedendum portions inside said pitch circle;

a major portion of each of said lobes extending generally radially outwardly from said pitch circle;

the profile of each of said lobes in a plane perpendicular to said axis having a tip portion and respective, generally convex leading and trailing flank portions extending intermediate said tip portion and the root portion of the respective adjacent grooves;

the improvement wherein the profile of said leading flank portion is formed of first and second circular arcs subscribed by first and second radii;

wherein the center of the first radius subscribing the first circular arc forming the male rotor lobe tip is on a radial line through the rotor center at an offset angle and is inside the pitch circle;

wherein the center of the second radius is inside the pitch circle and within the dedendum of the male rotor lobe, and wherein the point of tangency or blend of the second radius with the first radius occurs outside of the pitch circle;

and wherein the second circular arc defined by the second radius terminates inside the pitch circle within the dedendum of the male rotor lobe, resulting in improved sealing surfaces between the male rotor lobe and a corresponding female rotor groove and a female rotor groove having an increased swept volume resulting in more efficient compressor or expander operation while allowing the effective active pressure angle to be fine tuned.

8. The male rotor as claimed in claim 6, wherein in the area of the male rotor lobe tip, at the junction of the lobe trailing and leading flanks, a lobe surface portion is defined by a third circular arc subscribed by a third radius whose length is within the range of zero to five percent of the male rotor outside diameter, and wherein the center of that third radius is within the lobe addendum and positioned such that the third radius is tangent to the lobe trailing and leading flank surface portions at the intersection therewith of the circular arc subscribed by said third radius to facilitate rotor machine operating and/or cutting conditions, and to provide flexibility to the rotor profile without adversely affecting compressor or expander efficiency.

9. A pair of helical rotors for a screw rotor machine comprising:

a male rotor and a female rotor adapted to be rotatably mounted within a casing of said machine on respective parallel axes for intermeshing counter-rotation of said male and female rotors on such respective axes, said male rotor being rotatable about a central longitudinal axis and having a pitch circle centered on such axis, a plurality of elongated helical lobes extending longitudinally of said male rotor and circumferentially spaced about such pitch circle so as to provide intervening grooves therebetween outside of said pitch circle and lobe dedendum portions inside said pitch circle, said male rotor having an outside diameter radially beyond said pitch circle, a major portion of each of said male rotor lobes extending generally radially outwardly from said pitch circle, the profile of each of said male rotor lobes in a plane perpendicular to said axis having a tip portion and respective, generally concave lobe leading and trailing flank portions extending intermediate said tip portion and the root portion of the respective adjacent grooves, the profile of said male rotor lobe leading flank portion being formed of first and second circular arcs subscribed by first and second radii, the center of the first radius subscribing the first circular arc forming the male rotor lobe tip being on a radial line through the rotor center at an offset angle and inside said pitch circle, the center of said second radius being inside said pitch circle and within the dedendum of said male rotor lobe, the point of tangency or blend of said second radius with said first radius occurring outside said pitch circle, and wherein said second circular arc defined by said second radius terminates inside said pitch circle within the dedendum of said male rotor lobe, resulting in improved sealing surfaces relative to a corresponding female rotor groove when intermeshed therewith and a female rotor groove having an increased swept volume resulting in more efficient compressor or expander operation, while allowing the effective active pressure angle to be fine tuned, and said female rotor being rotatable about a central longitudinal axis and having a pitch circle centered on said axis, said female rotor having an outer diameter, a plurality of elongated helical lobes extending longitudinally of said female rotor and circumferentially spaced about said pitch circle so as to provide intervening grooves therebetween forming female rotor lobe addendum portions outside said pitch circle and dedendum portions inside said pitch circle, a major portion of each of said female rotor lobes extending generally radially inwardly of said pitch circle, the profile of each of said female rotor lobes in a plane perpendicular to said axis having a tip portion and respective generally concave groove leading and trailing flank portions extending intermediate said tip portion and a root portion of the respective adjacent grooves, and wherein said lobes of said female rotor engage grooves of said male rotor defined by corresponding helical lobes of said male rotor with contact between the flank portions of respective female and male rotor lobes during rotation of one rotor relative to the other, and the profile of the groove trailing flank portion of each female rotor lobe being defined by first and second circular arc portions subscribed by first and second radii within the addendum and dedendum portions of said female rotor lobe, respectively, providing a smooth uninterrupted surface starting below the pitch circle and terminating at or near the outside diameter of said female rotor with the point of tangency of said first and second radii of said female groove trailing flank portion occurring at a point of zero sliding with the male rotor on said pitch circle such that said female rotor lobe trailing flank portion facilitates female rotor drive of said male rotor, reduction in blow holes formed between the female and male screw rotors, and reduction of spreading forces acting on the rotors, opposing their rotation and loading of bearings mounting said rotors for rotation about their axes.

* * * * *